US007320529B2

(12) United States Patent
Goh et al.

(10) Patent No.: US 7,320,529 B2
(45) Date of Patent: Jan. 22, 2008

(54) ILLUMINATING BALLOON

(76) Inventors: Siong Kiat Goh, 62 Tannery La., Singapore 347804 (SG); Fei Che Hsieh, 7F, No. 177, Jen-1 Rd., Chung-Ho City, Taipei Hsien (TW)

( * ) Notice: Subject to any disclaimer, the term of this patent is extended or adjusted under 35 U.S.C. 154(b) by 78 days.

(21) Appl. No.: 11/258,016

(22) Filed: Oct. 26, 2005

(65) Prior Publication Data

US 2007/0103888 A1 May 10, 2007

(51) Int. Cl.
*F21V 33/00* (2006.01)

(52) U.S. Cl. ..... 362/96; 362/352; 362/189; 446/220

(58) Field of Classification Search ..... 362/352, 362/96, 189, 363, 806, 253; 446/224, 220, 446/485

See application file for complete search history.

(56) References Cited

U.S. PATENT DOCUMENTS 3,229,976 A * 1/1966 Allen, Jr. ..... 473/570
5,102,364 A * 4/1992 Kubiatowicz ..... 446/220
5,649,764 A * 7/1997 Strickland ..... 362/410
6,012,826 A * 1/2000 Chabert ..... 362/363
6,142,415 A * 11/2000 Ambrico ..... 244/33
6,892,772 B1 * 5/2005 Wang et al. ..... 141/313
2004/0228133 A1 * 11/2004 Tsao ..... 362/418

FOREIGN PATENT DOCUMENTS

JP 9306210 * 11/1997

* cited by examiner

*Primary Examiner*—Thomas M. Sember
(74) *Attorney, Agent, or Firm*—Troxell Law Office, PLLC

(57) ABSTRACT

An illuminating balloon includes an inflatable envelope and a sectional bulb support integrated in the envelope. The sectional bulb support includes a horizontally freely turnable top support to avoid tangling of the bulb support with the envelope during inflating. The top support defines an upper locking space for connecting the whole bulb support to a radially inward projected ring member integrally provided at a top center of the envelope without causing water leakage thereat. The sectional bulb support is height-adjustable and adaptable to differently sized inflatable envelopes, and has an open bulb-protecting grid that does not block light sources to produce shadows on the envelope, and an air-relieving hole to prevent the envelope from fluttering while being quickly inflated.

13 Claims, 8 Drawing Sheets

ILLUMINATING BALLOON

FIELD OF THE INVENTION

The present invention relates to an illuminating balloon, more particularly to an illuminating balloon that includes a height-adjustable sectional bulb support being integrated in an envelope of the balloon and having a horizontally freely turnable top support locked to a reinforced ring member integrally formed at a top center of the envelope to radially inward project therefrom, an open bulb-protecting grid, and an air-relieving hole.

BACKGROUND OF THE INVENTION

U.S. Pat. No. 6,012,826 discloses an illuminating balloon, which includes a bulb-protecting unit 14 integrated in an inflatable envelope 12. The bulb-protecting unit 14 is a fixedly sized grid downward closed to cover a bulb 16 therein. The bulb-protecting unit 14 is provided at a top with a rivet 46, which upward extends through a top of the envelope 12 to engage with a rivet thimble 48, so as to connect the upper end of the bulb-protecting unit 14 to the top of the envelope 12.

The following disadvantages are found in the above-structured illuminating balloon:

1. The rivet 46 upward extended through the top of the envelope 12 to engage with the rivet thimble 48 would inevitably produce a hole on the envelope 12, and rain-water would permeate into the envelope 12 via the hole to cause short circuit of the bulb 16 inside the envelope 12.
2. The fixedly sized bulb-protecting unit 14 is not height-adjustable, and is only adaptable to envelopes of the same size corresponding to that of the bulb-protecting unit 14. For other envelopes 12 of different sizes, separate bulb-protecting units 14 must be produced.
3. The fixedly sized bulb-protecting unit 14 could not be disassembled and stacked, and would therefore occupy a relatively large space and could not be conveniently carried, transported, and stored.
4. Once the bulb-protecting unit 14 is fixed to the top of the envelope 12 via the rivet 46, it is not rotatable relative to the envelope 12. Under this condition, the envelope 12 tends to tangle with the bulb-protecting unit 14 in the process of inflating.
5. The bulb-protecting unit 14 includes an integrally formed grid that would block part of the light from the bulb 16 to produce considerably significant shadows on the envelope 12 to adversely affect the appearance of the illuminating balloon.
6. A blower seat 18 is located at a bottom end of the envelope 12 for mounting a blower 52 thereto. Since the blower seat 18 does not include any air-relieving hole, the envelope 12 tends to flutter when it is too quickly inflated using the blower 52.

SUMMARY OF THE INVENTION

A primary object of the present invention is to provide an illuminating balloon that has a completely sealed and seamless top to eliminate the problem of water leakage.

Another object of the present invention is to provide an illuminating balloon using a height-adjustable sectional bulb support adaptable to differently sized inflatable envelopes.

A further object of the present invention is to provide an illuminating balloon having a sectional bulb support, which can be disassembled and then stacked to occupy a reduced space and be conveniently carried, transported, and/or stored.

A still further object of the present invention is to provide an illuminating balloon having an open bulb-protecting grid that does not block light sources to produce shadows on the balloon.

A still further object of the present invention is to provide an illuminating balloon that includes a sectional bulb support having a freely turnable top support to avoid tangling of an inflatable envelope of the balloon with the bulb support in the process of inflating the envelope.

A still further object of the present invention is to provide an illuminating balloon that allows relieving of extra air in the process of quickly inflating the balloon, lest the balloon should flutter while being inflated.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
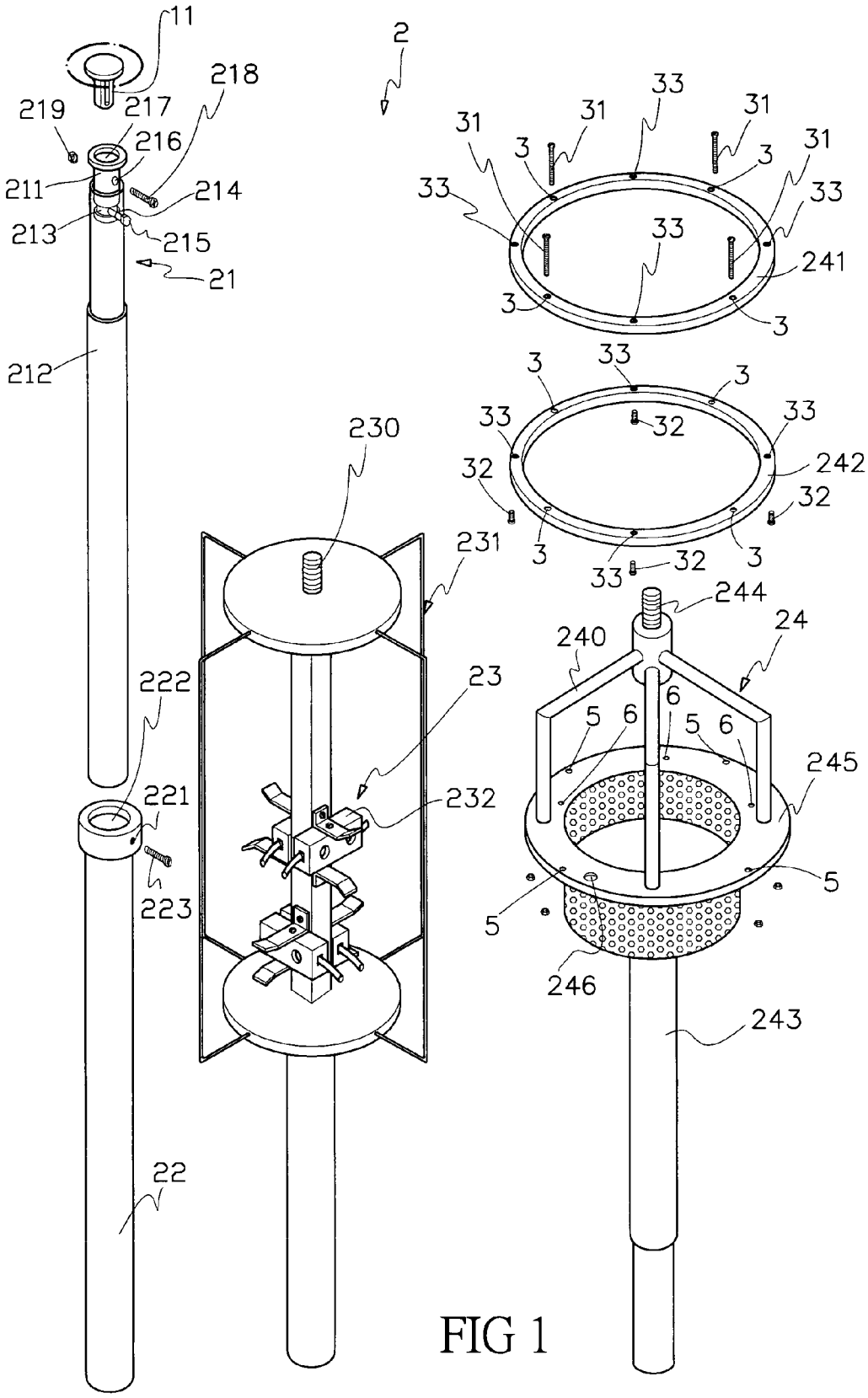
FIG. 1 is an exploded perspective view of a sectional bulb support for the illuminating balloon of the present invention.
Figure 2:
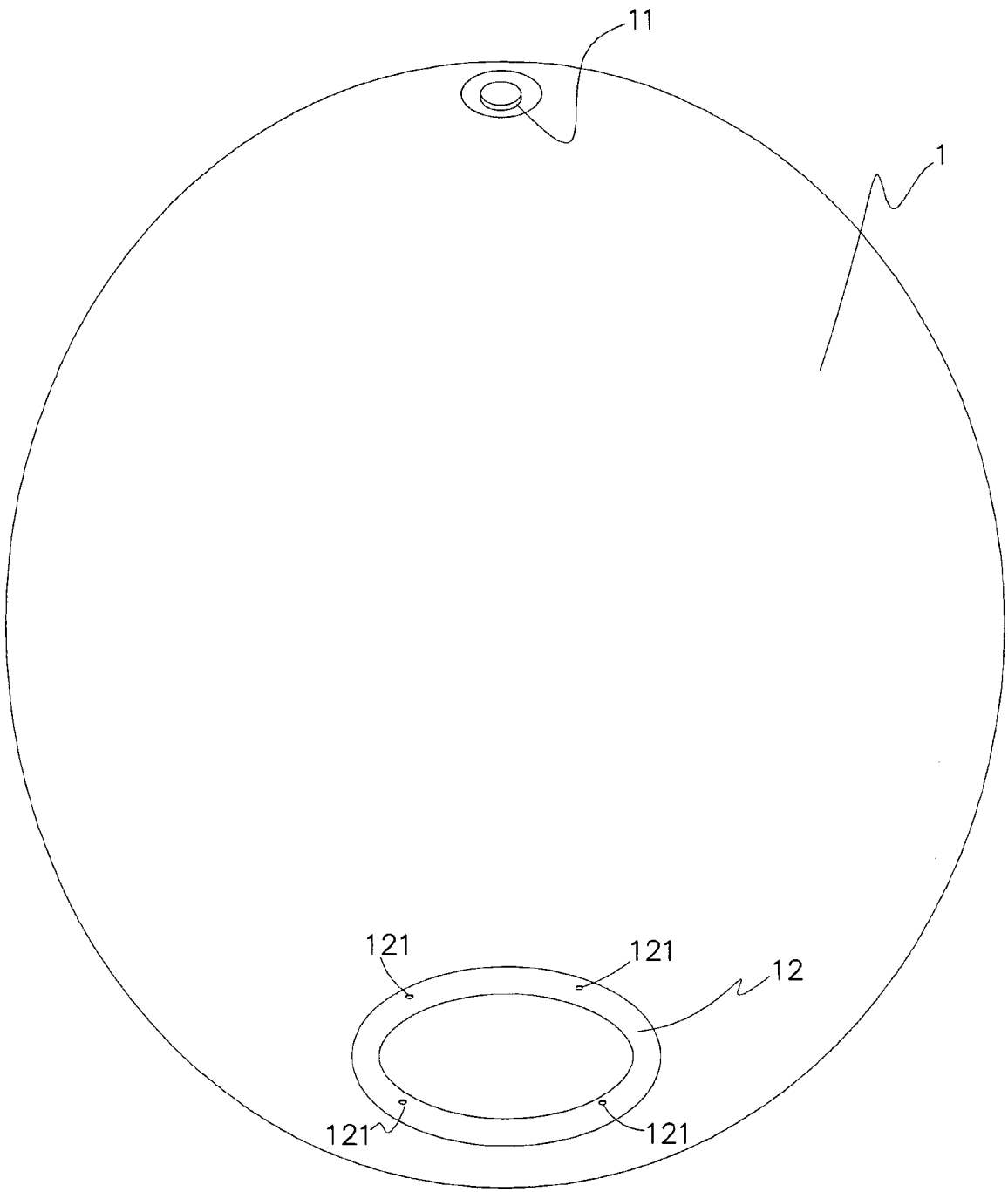
FIG. 2 shows an inflatable envelope for the illuminating balloon of the present invention.
Figure 3:
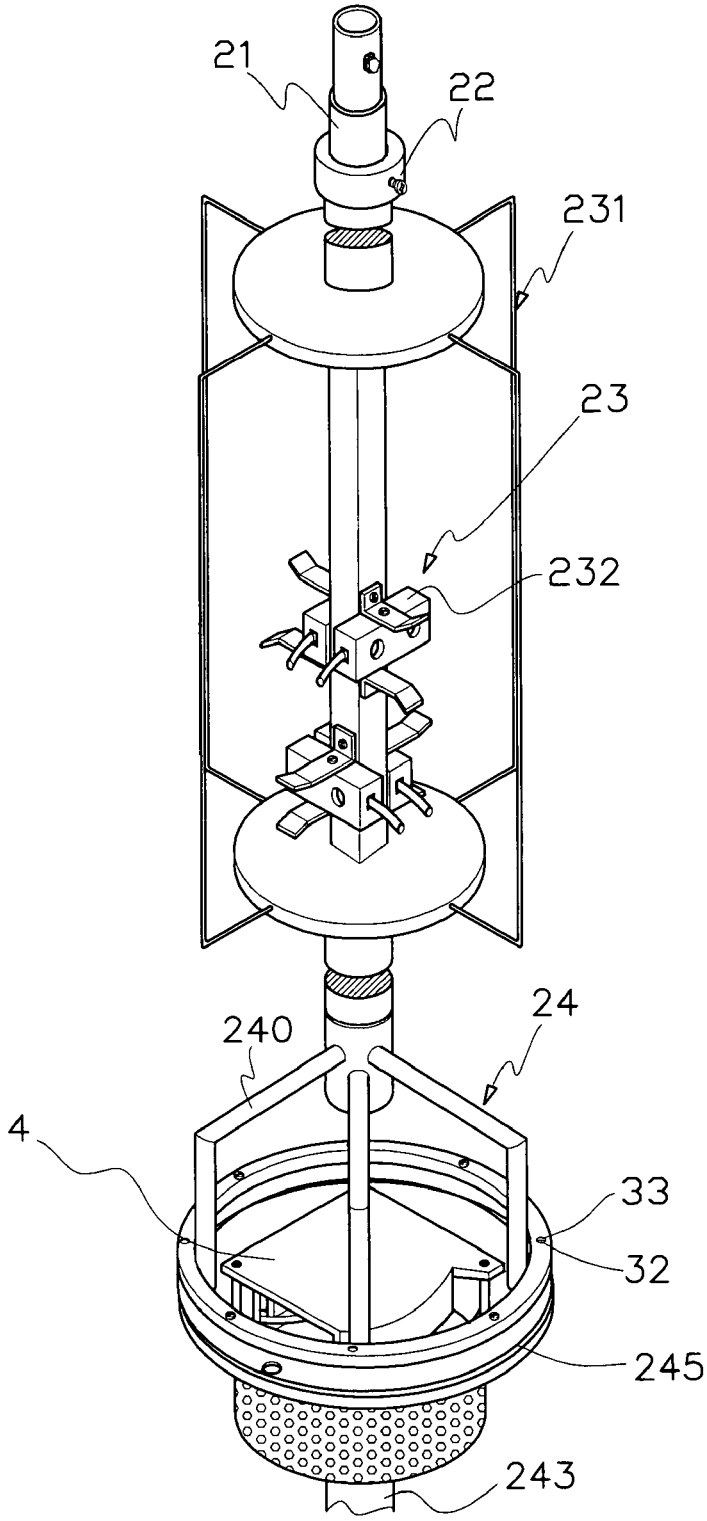
FIG. 3 is an assembled view of FIG. 1.

Please refer to FIGS. 1 and 3 that are exploded and assembled perspective views, respectively, of a sectional bulb support 2 for an illuminating balloon of the present invention, and to FIG. 2 that shows an inflatable envelope 1 of the illuminating balloon.

The inflatable envelope 1 is provided at a top central area with a radially inward projected reinforced ring member 11, and at a bottom central opening with a reinforced annular ring 12. A plurality of through holes 121 are spaced on the annular ring 12.

The sectional bulb support 2 includes a top support 21, a middle support 22, a lower support 23, and a bottom support 24. The top support 21 includes an upper tube 211 fitted in a lower tube 212. Please refer to FIGS. 5 and 6. The upper tube 211 is provided near a lower end thereof with an annular groove 213, and the lower tube 212 is provided near an upper end thereof with a radially extended through bore 214. After the upper tube 211 has been fitted in the lower tube 212, an insertion pin 215 may be extended through the bore 214 on the lower tube 212 into the annular groove on the upper tube 211, such that an outer end of the insertion pin 215 is abutted on an outer surface of the lower tube 212 to allow the upper tube 211 to horizontally freely rotate by 360 degrees relative to the outer tube 212. Therefore, in the process of inflating the envelope 1, the upper tube 211 in the envelope 1 is automatically turnable to adjust its position without twisting and tangling with the envelope 1. The upper tube 211 is also provided near an upper end thereof with a radially extended through bore 216, so that a screw 218 may be extended through the bore 216 into an inner space defined by an upper opening 217 of the upper tube 211 to finally engage with a nut 219 at one side of the upper tube 211 diametrically opposite to the bore 216. The reinforced ring member 11 radially inward projected from the top central area of the envelope 1 is inserted into the inner space defined by the upper opening 217 of the upper tube 211 and held thereto by the screw 218 extended through the bore 216 and the reinforced ring member 11 to engage with the nut 219. In this manner, the inflatable envelope 1 may have an integral top area without any hole or opening after the envelope 1 and the top support 21 are assembled together. Therefore, the problem of water leakage at the top central area of the inflatable envelope 1 is eliminated.

Figure 5:
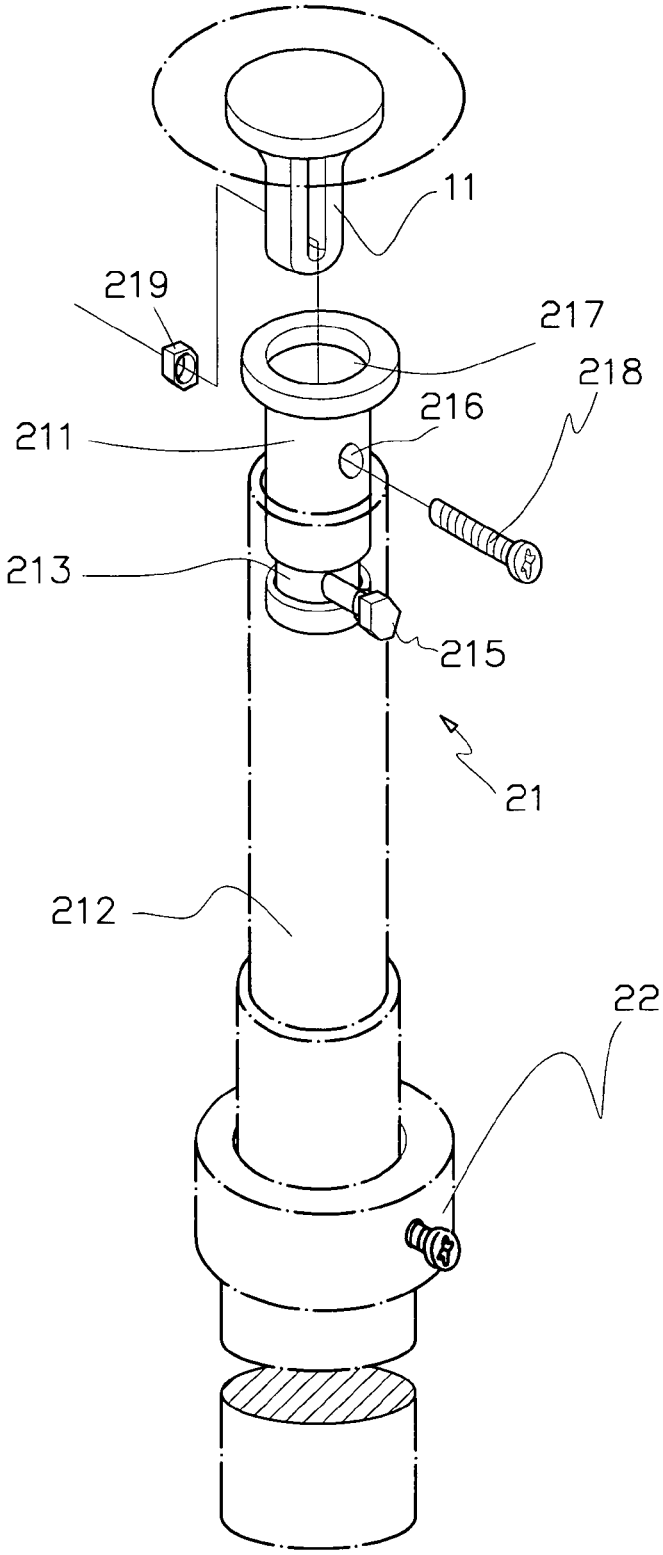
FIGS. 5 and 6 shows the connection of a top support of the sectional bulb support to a reinforced ring member provided at a top central area of the inflatable envelope of the illuminating balloon.
Figure 6:
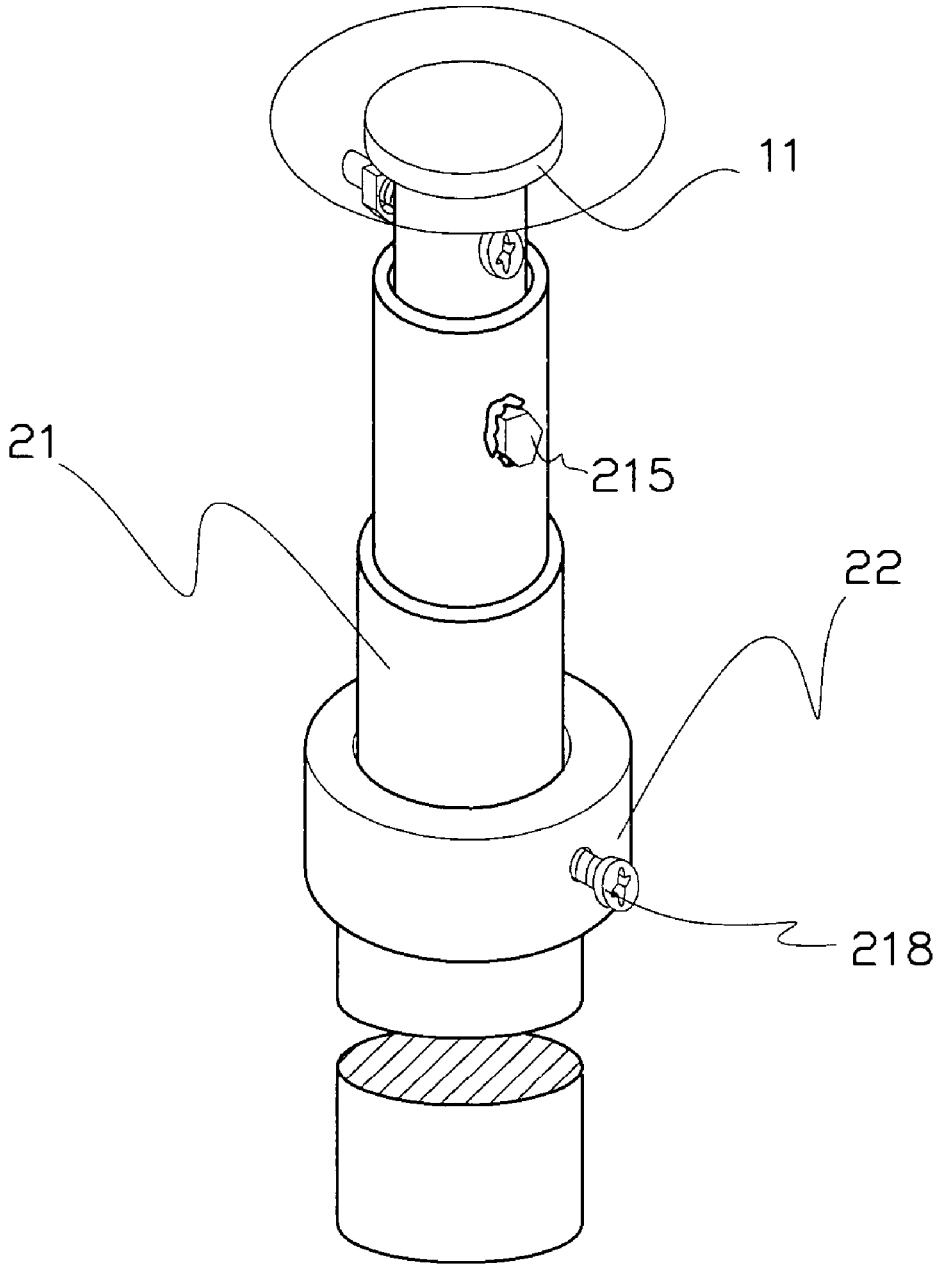
Figure 7:
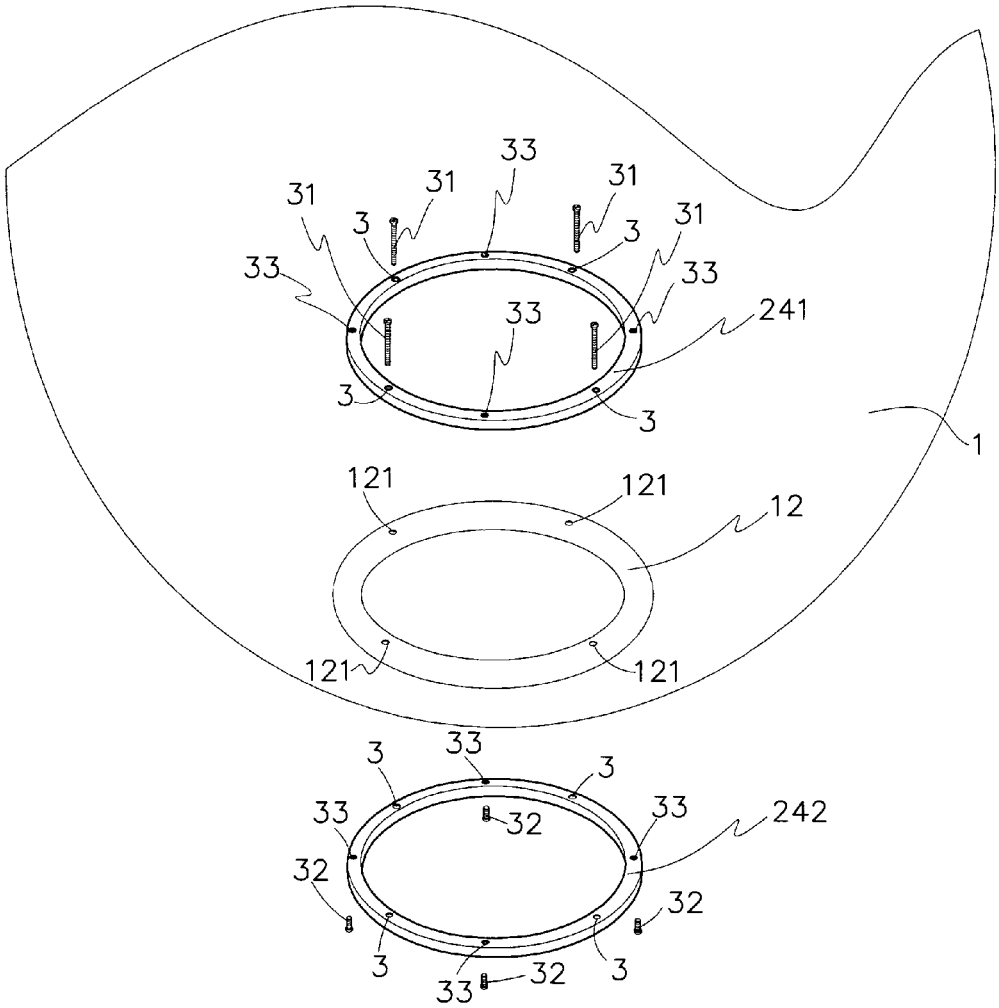
FIGS. 7 and 8 shows the connection of two clamping rings to a reinforced annular ring at a bottom central opening of the inflatable envelope of the illuminating balloon.
Figure 8:
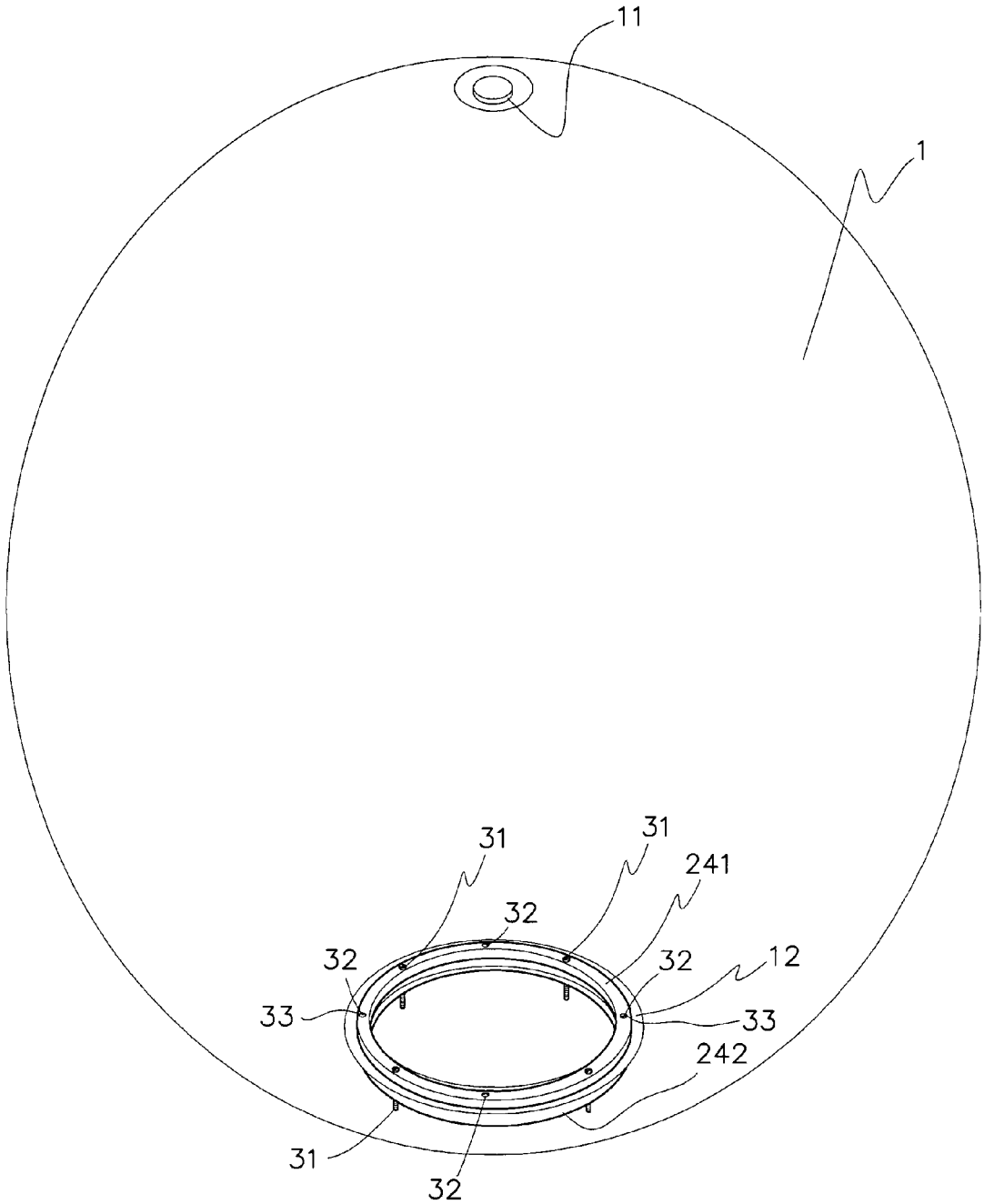

Please refer to FIGS. 1 and 5 at the same time. The middle support 22 has an inner bore 222 slightly larger than an outer diameter of the lower tube 212 of the top support 21, so that the top support 21 may be slidably fitted in the middle support 22. The middle support 22 is provided at a bottom center with a threaded hole (not shown), and near an upper end thereof with a radially extended and internally threaded through hole 221. A screw 223 may be extended through the threaded through hole 221 into the inner bore 222 to press against and thereby hold the lower tube 212 of the top support 21 to a desired height in the middle support 22.

Figure 4:
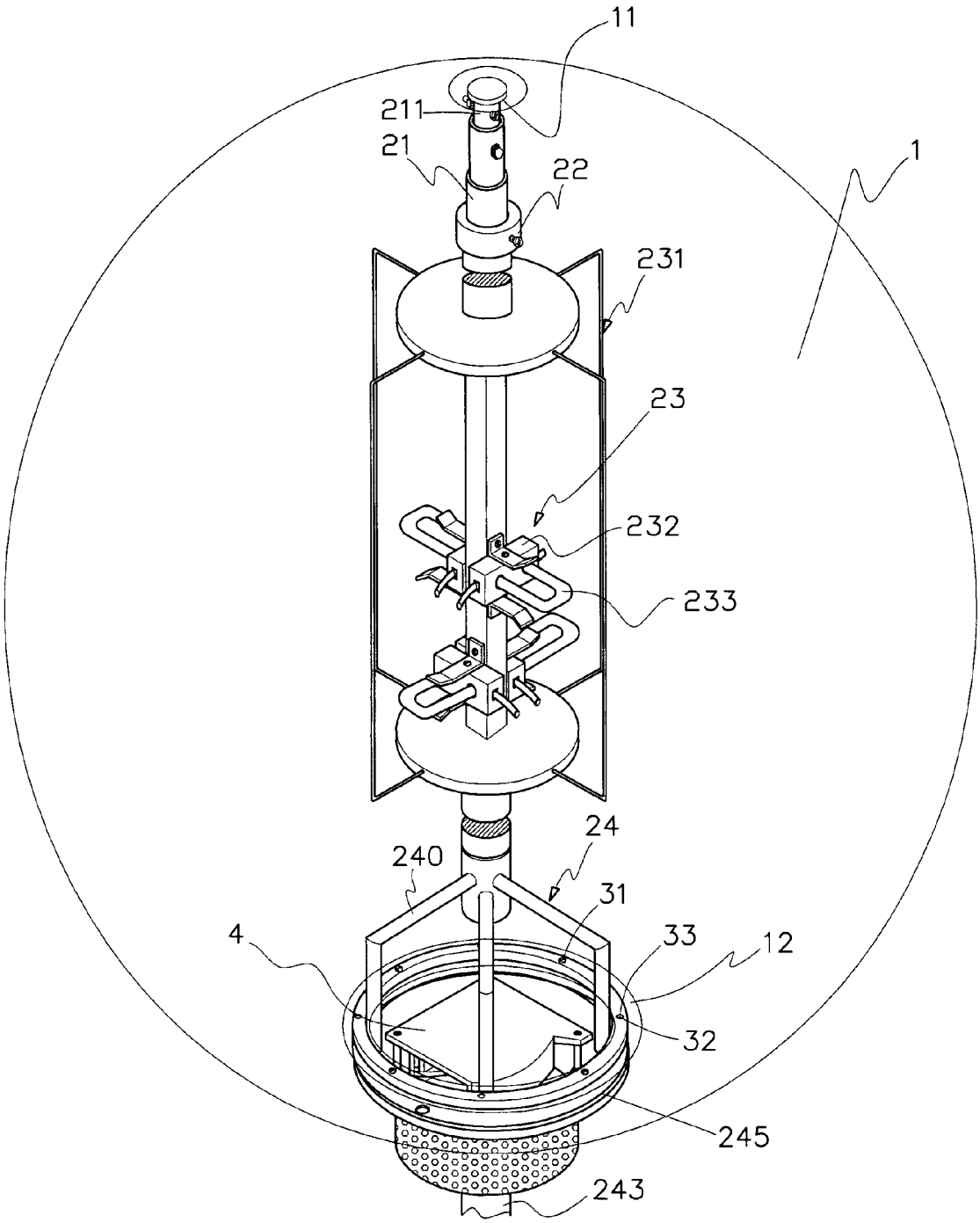
FIG. 4 shows the inflatable envelope with the assembled bulb support connected thereto.

Please refer to FIGS. 1, 3, and 4 at the same time. The lower support 23 is provided at a top center with an upward projected screw 230 for screwing into the internally threaded hole provided at the bottom center of the middle support 22 to connect the middle and the lower support 22, 23 together. The lower support 23 is also provided at a bottom center with an internally threaded hole (not shown). The lower support 23 includes an open bulb-protecting grid 231, inside which bulb holders 232 and bulbs 233 are installed. With the open bulb-protecting grid 231, light sources are not blocked to produce shadows on the envelope 1.

The bottom support 24 includes an upper clamping ring 241, a lower clamping ring 242, and a blower-supporting frame 243. The upper and the lower clamping ring 241, 242 are correspondingly provided with a plurality of spaced through holes 3 to aligned with the through holes 121 on the reinforced annular ring 12 at the bottom central opening of the inflatable envelope 1. The blower-supporting frame 243 includes a supporting frame 240, at a top center of which an upward projected screw 244 is provided for screwing into the threaded hole at the bottom center of the lower support 23 to connect the lower and the bottom support 23, 24 together. The blower-supporting frame 243 also includes a blower seat 245 located below the supporting frame 240 for a blower 4 to fixedly seat therein. The blower seat 245 is provided along an upper surface thereof with a plurality of spaced first mounting holes 5 corresponding to the through holes 3 on the two clamping rings 241, 242, and second mounting holes 6 for connecting the blower 4 to the blower seat 245. An air-relieving hole 246 is provided on the upper surface of the blower seat 245 for relieving extra air in the process of inflating the envelope 1, lest the envelope 1 should flutter while being inflated.

Please refer to FIGS. 3, 4, 7, and 8 at the same time. When the sectional bulb support 2 is fully assembled, it is connected to the inflatable envelope 1 by sequentially downward extending screws 31 through the holes 3 on the upper clamping ring 241 and the holes 121 on the reinforced annular ring 12, and then upward extending screws 32 through holes 33 on the lower clamping ring 242, so that the reinforced annular ring 12 at the bottom central opening of the envelope 1 is firmly clamped between the two clamping rings 241, 242. Finally, the screws 31 are further downward threaded through the first mounting holes 5 on the blower seat 245 on the blower-supporting frame 243 to complete the illuminating balloon of the present invention, which is very practical for use.

What is claimed is:

1. An illuminating balloon, comprising: an inflatable envelope being provided at a top central area with a radially inward extended reinforced ring member, and at a bottom central opening with a reinforced annular ring; and a sectional bulb support integrated in said envelope and consisting of a top support, a middle support, a lower support, and a bottom support, wherein said top support includes an upper tube and a lower tube in which said upper tube is rotatably fitted; said upper tube being provided near a lower end thereof with an annular groove, and said lower tube being provided near an upper end thereof with a radially extended through bore, wherein said upper tube is provided near an upper end thereof with a radially extended through bore, via which a bore screw is extended into an inner space defined by an upper opening of said upper tube for receiving said reinforced ring member therein, and said bore screw is finally engaged with a nut at one side of said upper tube diametrically opposite to said through bore to lock said upper tube to said reinforced ring member.

2. The illuminating balloon as claimed in claim 1, wherein said inflatable envelope is provided on said annular ring at the bottom central opening with a plurality of spaced through holes.

3. The illuminating balloon as claimed in claim 1, wherein said upper tube is rotatably held in said lower tube by extending an insertion pin through said bore on said lower tube into said annular groove on said upper tube, such that an outer end of said insertion pin is abutted on an outer surface of said lower tube.

4. The illuminating balloon as claimed in claim 1, wherein said middle support has an inner bore slightly larger than an outer diameter of said lower tube of said top support, so that said top support is axially slidably fitted in said middle support; and said middle support being provided at a bottom center with a threaded hole, and near an upper end thereof with a radially extended and internally threaded through hole.

5. The illuminating balloon as claimed in claim 4, wherein said lower tube of said top support is held in said middle support at a desired height by extending a screw through said radially extended and internally threaded through hole near the upper end of said middle support to press against said lower tube.

6. The illuminating balloon as claimed in claim 1, wherein said lower support is provided at a top center with an upward projected screw, and at a bottom center with an internally threaded hole.

7. The illuminating balloon as claimed in claim 1, wherein said lower support is connected to said middle support by screwing a screw upward projected from a top center of said lower support into an internally threaded hole provided at a bottom center of said middle support.

8. The illuminating balloon as claimed in claim 1, wherein said lower support includes an open bulb-protecting grid.

9. The illuminating balloon as claimed in claim 1, wherein said bottom support includes an upper clamping ring, a lower clamping ring, and a blower-supporting frame; said upper and said lower clamping ring being correspondingly provided with a plurality of spaced through holes, and said blower-supporting frame including a supporting frame, at a top center of which an upward projected screw is provided.

10. The illuminating balloon as claimed in claim 9, wherein said screw upward projected from the top center of said supporting frame of said blower-supporting frame of said bottom support is screwed into a threaded hole at a bottom center of said lower support to connect said lower and said bottom support together.

11. The illuminating balloon as claimed in claim 9, wherein said blower-supporting frame further includes a blower seat located below said supporting frame for a blower to fixedly seat therein.

12. The illuminating balloon as claimed in claim 11, wherein said blower seat is provided along an upper surface thereof with a plurality of spaced first mounting holes corresponding to said through holes on said upper and lower clamping rings, and second mounting holes for connecting said blower to said blower seat.

13. The illuminating balloon as claimed in claim 12, wherein said blower seat is provided on the upper surface with an air-relieving hole.

* * * * *